US007485824B2

(12) United States Patent
Rastemborski et al.

(10) Patent No.: US 7,485,824 B2
(45) Date of Patent: Feb. 3, 2009

(54) ELECTRICAL SWITCH COMPONENT

(75) Inventors: Axel Rastemborski, Spaichingen (DE); Bernd Hellbeck, Pliezhausen (DE)

(73) Assignees: Marquardt GmbH, Rietheim-Weilheim (DE); DaimlerChrysler AG, Munich (DE)

( * ) Notice: Subject to any disclaimer, the term of this patent is extended or adjusted under 35 U.S.C. 154(b) by 0 days.

(21) Appl. No.: 11/358,684

(22) Filed: Feb. 21, 2006

(65) Prior Publication Data

US 2006/0201797 A1 Sep. 14, 2006

Related U.S. Application Data

(63) Continuation of application No. PCT/EP2004/009341, filed on Aug. 20, 2004.

(30) Foreign Application Priority Data

Aug. 23, 2003 (DE) ..... 103 38 903

(51) Int. Cl.
*H01H 1/10* (2006.01)

(52) U.S. Cl. ..... 200/516; 200/406

(58) Field of Classification Search ..... 200/293, 200/516

See application file for complete search history.

(56) References Cited

U.S. PATENT DOCUMENTS

| | | | | |
|---|---|---|---|---|
| 4,013,857 | A * | 3/1977 | Tanaka | 200/315 |
| 4,045,637 | A * | 8/1977 | Mongeau | 200/303 |
| 5,055,642 | A | 10/1991 | Miyata | |
| 5,660,272 | A | 8/1997 | Janniere et al. | |
| 6,388,220 | B1 * | 5/2002 | Sasaki et al. | 200/537 |
| 6,501,036 | B2 * | 12/2002 | Rochon et al. | 200/302.2 |
| 6,530,283 | B2 * | 3/2003 | Okada et al. | 73/780 |
| 6,610,950 | B1 * | 8/2003 | Kamio et al. | 200/406 |
| 6,946,610 | B2 * | 9/2005 | Takeuchi et al. | 200/406 |
| 7,005,596 | B2 * | 2/2006 | Maeda et al. | 200/314 |
| 2006/0131153 | A1 * | 6/2006 | Asada | 200/341 |

FOREIGN PATENT DOCUMENTS

| | | | |
|---|---|---|---|
| DE | 34 21 319 | A1 | 12/1985 |
| DE | 91 05 230 | U1 | 7/1991 |
| EP | 0 743 663 | A1 | 11/1996 |
| EP | 0 880 157 | A2 | 11/1998 |
| EP | 1 143 469 | A1 | 10/2001 |
| FR | 2 800 904 | A1 | 5/2001 |
| JP | 10-255579 | A1 | 9/1998 |
| JP | 2003-257271 | A1 | 9/2003 |

* cited by examiner

*Primary Examiner*—Elvin G Enad
*Assistant Examiner*—Lheiren Mae A Anglo
(74) *Attorney, Agent, or Firm*—Burr & Brown

(57) ABSTRACT

An electrical switch, in the form of a short-stroke key is provided, including a housing having a base and a cover fixed to the base. A contact system is located in the housing, and an actuating member acts on the contact system in a switching manner. The base has a cutout in the underside that is positioned remote from the cover. The cover at least partially covers the base on the upper side and on the side face of the base, and an attachment on the cover engages the cutout in a flange manner such that the attachment is accommodated in the base and is at the most flush with the underside of the base.

27 Claims, 6 Drawing Sheets

ELECTRICAL SWITCH COMPONENT

CROSS REFERENCE TO RELATED APPLICATIONS

This application is a continuation of International Application No. PCT/EP2004/009341, having an international filing date of Aug. 20, 2004, which designated the United States, and claims the benefit under 37 CFR §119(a)-(d) of German Application No. 103 38 903.2, filed Aug. 23, 2003, the entireties of which are incorporated herein by reference.

FIELD OF THE INVENTION

The present invention relates to an electrical component, in particular an electrical switch.

BACKGROUND OF THE INVENTION

Such electrical switches, which may be in the form of a short-stroke key, are primarily used as switching elements in keyboards, control panels etc.

JP 10 255 579 A discloses an electrical switch in the form of a short-stroke key having a housing, and a contact system located in the housing. The switch also has an actuating member for acting on the contact system. The housing comprises a base and a cover, the flat cover being fixed to the upper side of the base. One disadvantage of this switch has been found to be the complex manner in which the cover is fixed. Furthermore, the housing is not impervious to contaminants, with the result that the switch is susceptible to faults.

EP 0 743 663 A1 also discloses an electrical switch, where the cover is pushed over the base. The cover therefore covers the base on the upper side and at least partially on the side face. The cover is fixed by means of latching tabs that are latched onto latching lugs located on a side face of the base. This manner of fixing the cover is complex and susceptible to faults as well. Furthermore, the laterally protruding latching lugs on the base are disadvantageous, and above all, make it necessary for the base to have a significant physical size.

SUMMARY OF THE INVENTION

An object of the present invention is to improve such electrical components, in particular electrical switches, regarding the design of the housing. In particular, it should be possible to mount the cover on the base of the electrical switch in a simple and failsafe manner.

This object is achieved by providing an electrical component, in particular an electrical switch, according to the present invention.

In the electrical component or electrical switch according to the present invention, the base has at least one cutout in the underside that is positioned remote from the cover. A tab-like attachment on the cover engages in the manner of a flange so as to protrude into this cutout such that the attachment is completely accommodated in the base. The flange can be created in a simple manner in terms of manufacturing technology. This results in the cover being fixed in a reliable manner to the base, while the housing is largely impervious to the ingress of contaminants. Since the attachment protruding into the cutout is flush with the underside of the base, i.e. in particular does not protrude beyond the underside of the base, the switch can advantageously be mounted in a simple manner on a carrier, a printed circuit board or the like, owe to its planar lower surface. Further refinements of the present invention are also provided as described below.

The cover and the base of the electrical component and/or the electrical switch generally have an approximately rectangular shape with four sides. It is thus possible for four attachments on the cover to engage in four cutouts, corresponding thereto, in the base, as a result of which secure and sufficient fixing of the cover to the base is achieved. The attachments and the cutouts are expediently assigned approximately centrally to the four sides of the cover and the base. In a mounting-friendly manner, the attachment on the cover may be in the form of a flanged tab extending from the side face to the underside.

The contact system of the switch comprises, in a manner known per se, fixed contacts and a switching contact, which can be actuated by means of the actuating member. The fixed contacts can be located on the upper side of the base in the housing. In order that the switch has a small physical size, the switching contact may be in the form of a snap-in disk for the purpose of bridging the fixed contacts. A particularly good, tactile feel for the user can be achieved by the snap-in disk being made from metal.

Electrical terminals, which are electrically connected to the fixed contacts, are arranged on the underside of the base. If the switch is designed such that it is capable of illuminating, a luminous element, for example a light-emitting diode, is located in the housing. The electrical terminals for the luminous element are likewise arranged on the underside of the base. In order to make it easy for the electrical switch to be mounted, it is possible for the electrical terminals to be in the form of soldering surfaces in the manner of SMD (surface mounted device) terminals. The flat, lower surface of the base, even as regards the tab-like attachments on the cover, then advantageously makes it possible for the switch to be processed and fitted using SMD (surface mounted device) technology.

In a particularly simple and cost-effective manner, a printed circuit board can be used as the base for the switch. The fixed contacts can then be in the form of conductor track surfaces on the upper side of the printed circuit board acting as the base. The electrical connection between the electrical terminal on the underside of the base and the fixed contact on the upper side of the base is formed by means of a conductor track and/or a throughplating. The fixed contacts and the electrical connections can thus be produced using tried-and-tested and reliable printed circuit board technology.

The actuating member has a pushbutton protruding out of the housing and an edge surface resting on the upper side of the base. The pushbutton is connected to the edge surface via a bellows which can buckle in elastically. Furthermore, the pushbutton acts on the switching contact by means of an attachment. Such a design firstly saves on components because the overall functionality of the actuating member is realized by means of one part. Secondly, the switch is then also sealed off on the upper side of the housing by means of the actuating member, which prevents the ingress of contaminants into the switch.

With such a design it is possible for the actuating member to be made at least partially, in particular its edge surface and its bellows, from an elastomeric plastic. For example, silicone can be used as the elastomeric plastic. The pushbutton is made at least partially, in particular on its actuating surface, from a hard plastic. In a cost-effective manner, the actuating member can then be produced from the elastomeric plastic and the hard plastic using two-component technology.

For reasons of robustness, the cover may be made from metal. The cover preferably has a form of a frame having an opening such that the frame firstly covers, in the manner of a profile, the edge surface of the actuating member and holds it firmly on the base and secondly allows the bellows of the actuating member to pass through. The cover advantageously fulfills the function of accommodating further components of the switch, in particular the actuating member, and fixing them by means of pressure to the base. This pressure also ensures a tight connection.

In one particular development for an electrical switch capable of illuminating, the snap-in disk forming the switching contact is provided with a hole. The luminous element is arranged in the region of the hole on the upper side of the base such that the light emitted by the luminous element can pass at least partially through the hole in the snap-in disk. As a result, the switch has a very compact design despite the additional illumination. Furthermore, it is then possible for the actuating member to be made at least partially from a transparent material.

The snap-in disk is in electrical contact with one fixed contact by means of a resting surface opposite the hole. The other fixed contact is annular and is arranged so as to correspond to the edge around the hole. The luminous element is located approximately in the center of the annular fixed contact. The edge around the hole in the snap-in disk is designed to be raised with respect to the resting surface. The attachment on the pushbutton is likewise annular, the attachment interacting with the raised edge around the hole in the snap-in disk so as to actuate it. As a result, the raised edge comes to bear, in snap-action fashion, against the annular fixed contact when the snap-in disk is actuated by the actuating member. Such a design ensures a space-saving arrangement of the luminous element.

The advantages achieved by the present invention consist in particular in the fact that the electrical switch has only a low physical height and can therefore be used as a short-stroke key. In addition, the switch can be further processed in a simple manner, in particular can be fitted with SMDs (surface mounted devices), and can thus be used in a mounting-friendly and cost-effective manner in control panels. Despite the simple design, the housing of the switch is largely sealed, which effectively prevents the ingress of contaminants into the housing. The soldering process for the switch on a carrier, for example in the control panel, thus does not lead to any loss of function. Primarily, exposure to a temperature of 260° C. over a period of at least 30 seconds is not damaging to the switch, which makes it possible for the switch to be processed using SMD (surface mounted device) technology.

The present invention makes it possible to use a printed circuit board for the base of the electrical component and/or the electrical switch and to connect this printed circuit board to the cover and possibly further components. The printed circuit board in turn provides the advantage of combining terminal surfaces, electrical connections, contact areas and the bottom part of the electrical component and/or the electrical switch in a cost-effective manner to form one component.

BRIEF DESCRIPTION OF THE DRAWINGS

An exemplary embodiment of the present invention with various refinements and developments will be described in more detail below and is illustrated in the drawings, in which.

DETAILED DESCRIPTION OF THE INVENTION

Figure 1:
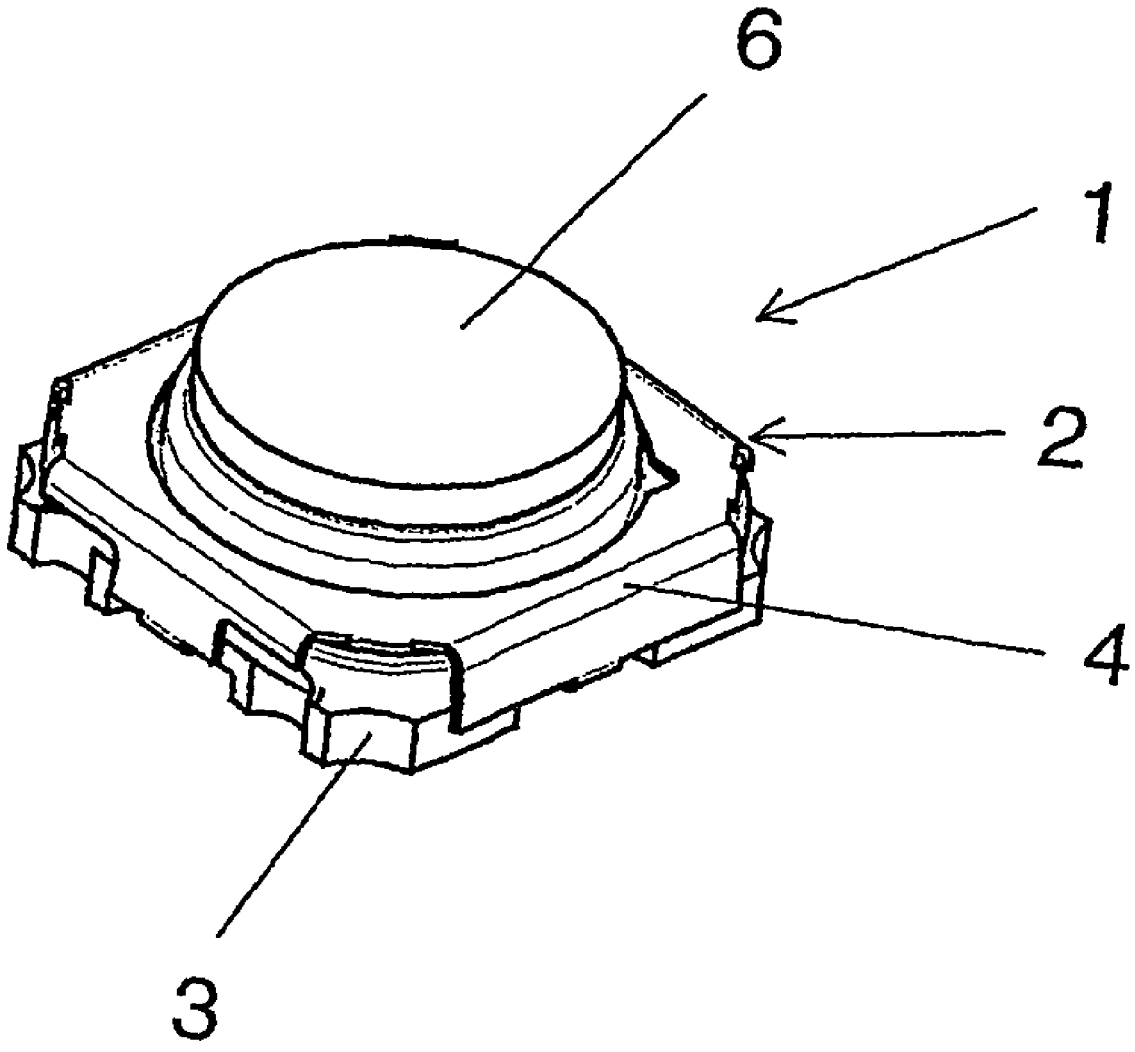
FIG. 1 is a perspective view of an electrical switch.

FIG. 1 shows a perspective view of an electrical switch 1, which is in the form of a short-stroke key. Such a switch 1 is particularly suitable for use in control panels for motor vehicles, for household appliances, for other electrical appliances or the like.

Figure 2:
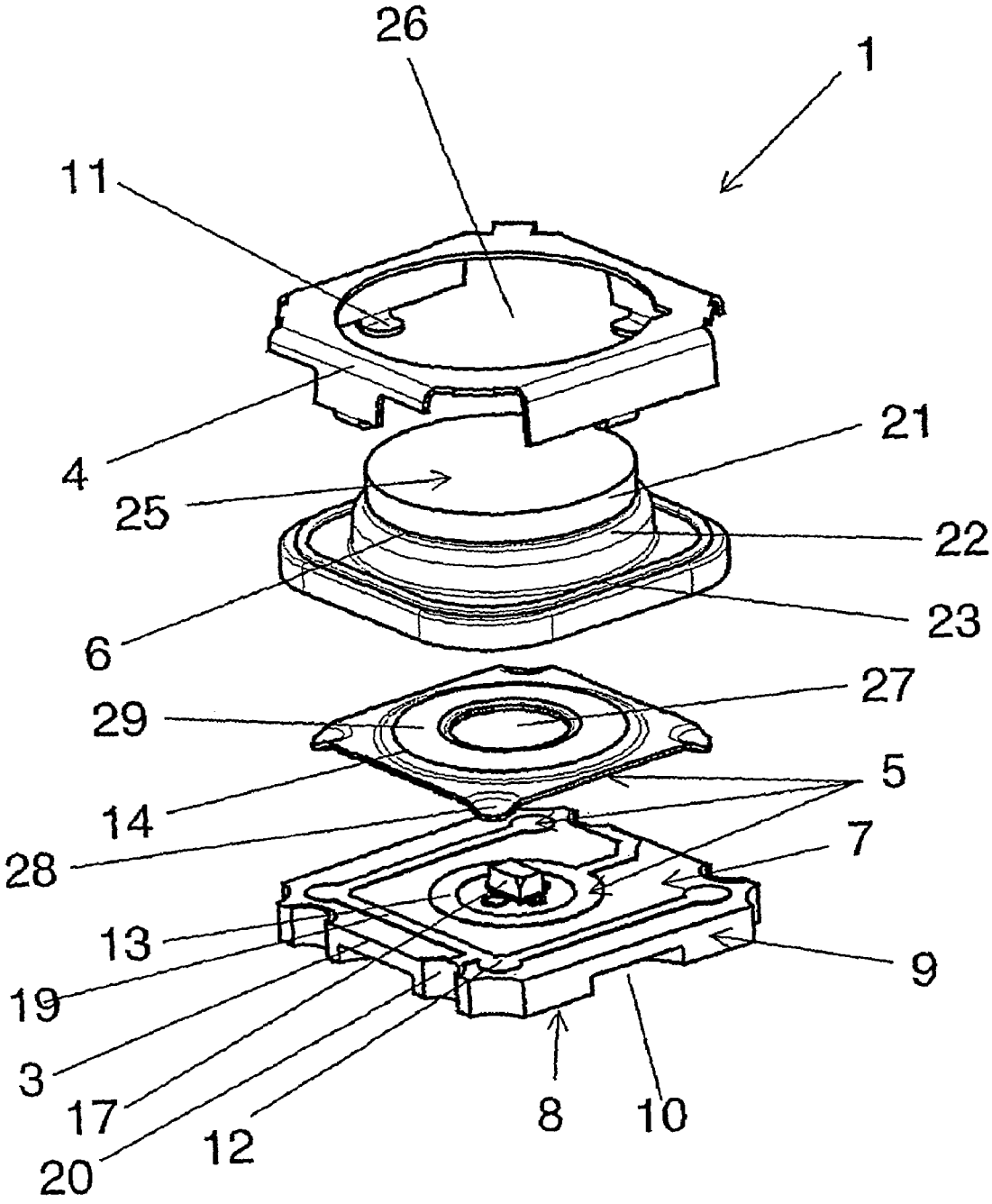
FIG. 2 is an exploded view of the electrical switch.
Figure 3:
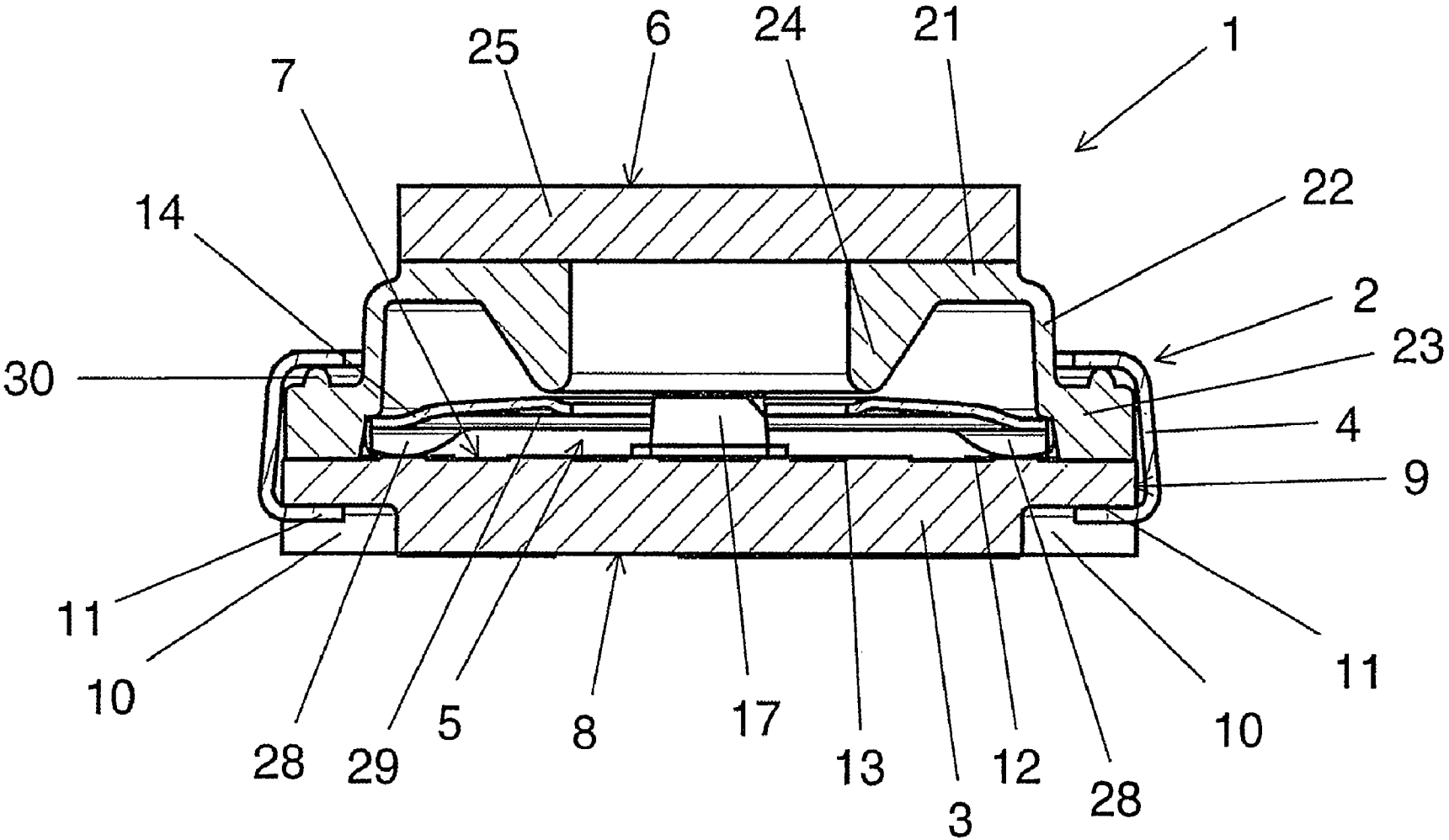
FIG. 3 is a longitudinal sectional view taken through the electrical switch in FIG. 1.

The switch 1 has a housing 2. A contact system 5, shown in FIG. 2, is located in the housing 2. Furthermore, the switch 1 has an actuating member 6, which is used by the user to exert a manual switching action on the contact system 5. The housing 2 comprises a base 3 and a cover 4, the cover 4 being fixed to the base 3. For this purpose, the cover 4 at least partially covers the base 3 on the upper side 7 and on the side face 9, as can be seen in FIG. 3. Furthermore, the base 3 has at least one cutout 10 in the underside 8 remote from the cover 4. An attachment 11 in the form of a tab on the cover 4 engages in the cutout 10 such that the attachment 11 is completely accommodated in the base 3. The attachment 11 thus does not protrude beyond the underside 8 of the base 3, but is at the most flush with the underside 8 of the base 3, which can be seen clearly in FIG. 3.

Figure 6:
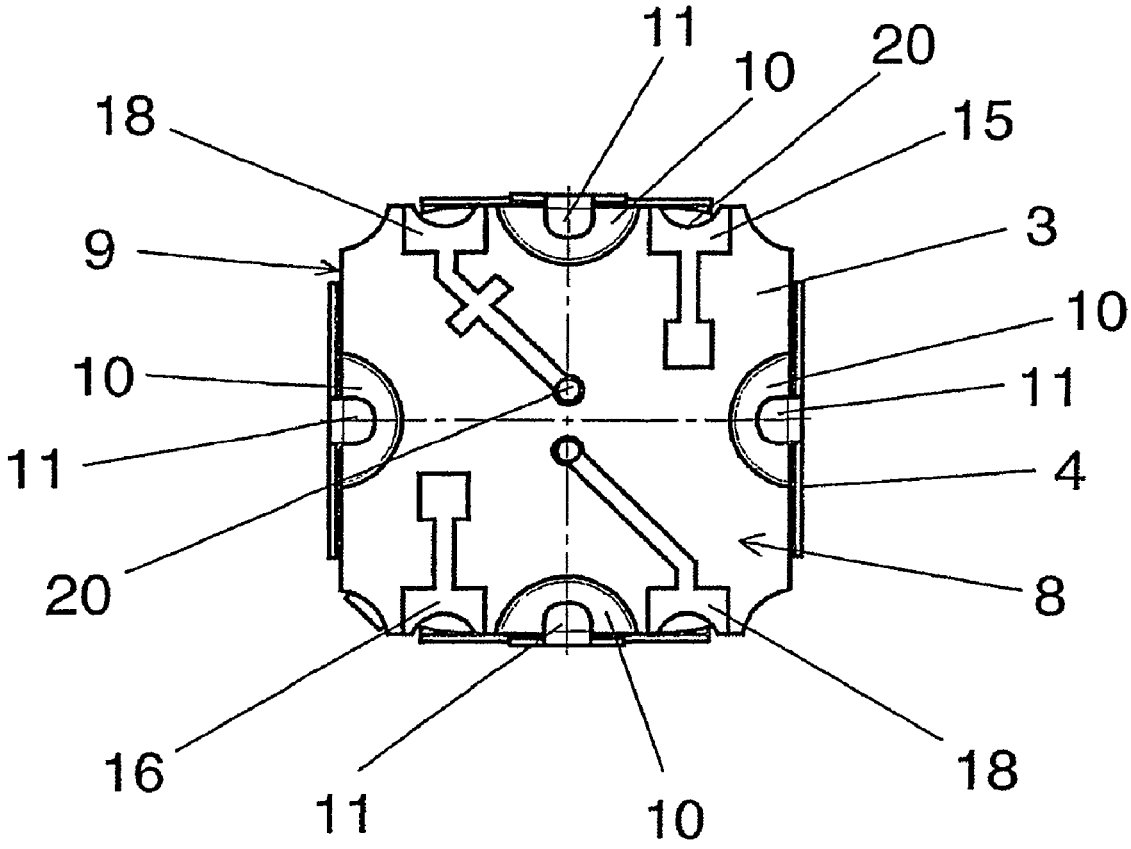
FIG. 6 is the underside of the electrical switch.

As shown in FIG. 6, in this case a cutout 10 is assigned to each side face 9 of the approximately rectangular or square base 3, with the result that the switch 1 has in total four cutouts 10. The rectangular or square cover 4 thus also has four corresponding attachments 11 for the purpose of engaging in the cutouts 10 in the manner of a flange. The attachments 11 and the cutouts 10 are in this case assigned approximately centrally to the four sides of the cover 4 and the base 3. The flanging by means of the tab-like attachment 11 extending from the side face 9 to the underside 8 means that the cover 4 is fixed securely to the base 3.

As can be seen in FIG. 2, the contact system 5 comprises fixed contacts 12, 13 and a switching contact 14, which can be actuated by means of the actuating member 6. The fixed contacts 12, 13 are located on the upper side 7 of the base 3 in the housing 2. The switching contact 14 is in the form of a snap-in disk for the purpose of bridging the fixed contacts 12, 13. The snap-in disk 14 may be made from metal.

The base 3 comprises a printed circuit board. Electrical terminals 15, 16, which can be seen in FIG. 6 and are electrically connected to the fixed contacts 12, 13, are arranged on the underside 8 of the base 3. Further electrical terminals 18 for a luminous element 17 located in the housing 2 are likewise arranged on the underside 8 of the base 3. The luminous element 17 may be, for example, a light-emitting diode. The electrical terminals 15, 16, 18 are in the form of soldering surfaces such that the switch 1 can be processed using SMD (surface mounted device) technology. The fixed contacts 12, 13 are in the form of conductor track surfaces on the upper side 7 of the base 3, as can be seen in FIG. 2. The electrical connection between the electrical terminal 15, 16, 18 on the underside 8 of the base 3 and the fixed contact 12, 13 on the upper side 7 of the base 3 is formed by means of a conductor track 19 and/or a throughplating 20.

Figure 4:
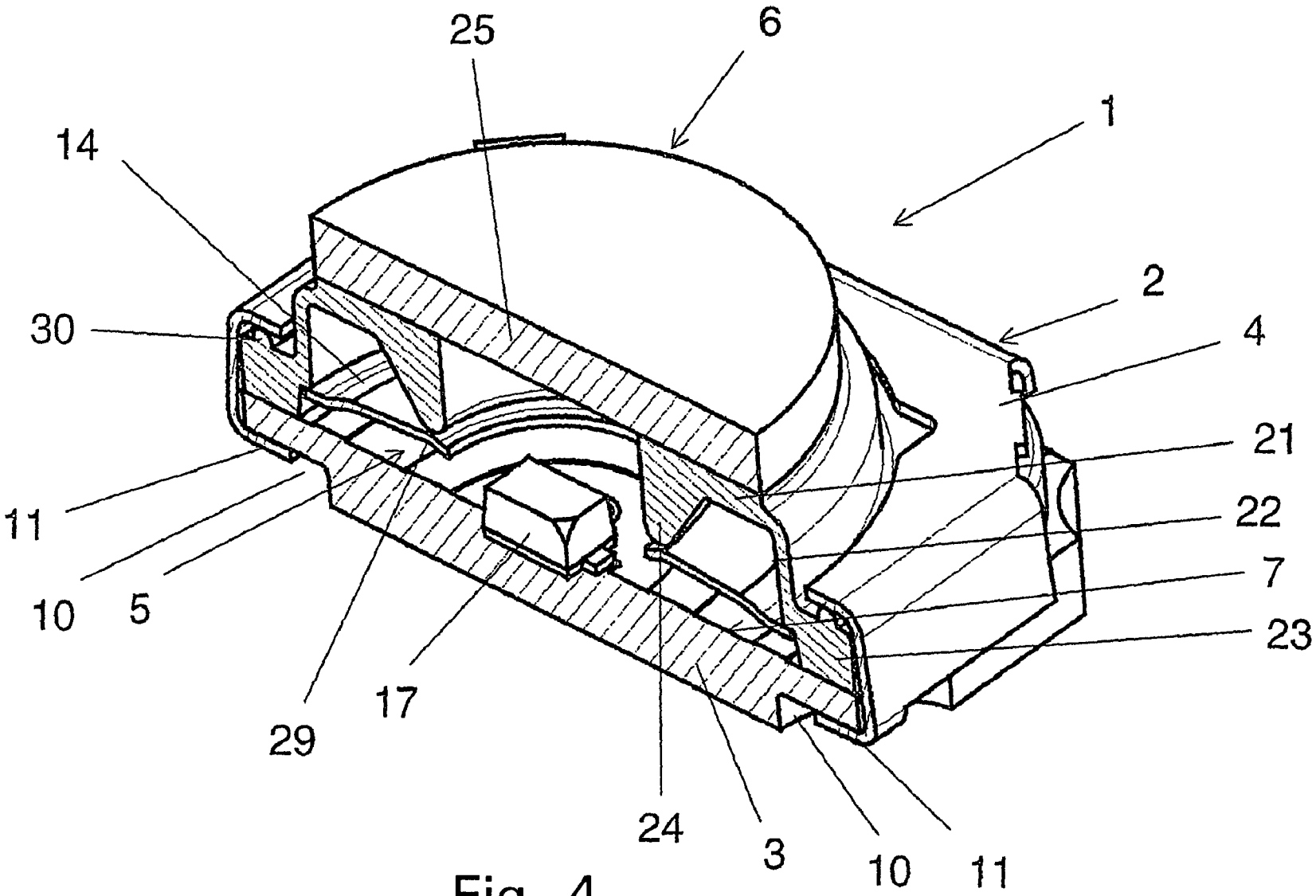
FIG. 4 is a perspective view of the longitudinal sectional view of FIG. 3.

As can also be seen in FIG. 3 or 4, the actuating member 6 has a pushbutton 21 protruding out of the housing 2 and an edge surface 23 resting on the upper side 7 of the base 3. The pushbutton 21 is connected to the edge surface 23 via a bellows 22 which can buckle in elastically. The pushbutton 21 acts on the switching contact 14 by means of an attachment 24. The actuating member 6 is made at least partially, to be precise in particular its edge surface 23 and its bellows 22, from an elastomeric plastic, for example from silicone. The pushbutton 21 is made at least partially, to be precise in particular on its actuating surface 25, from a hard plastic. In this case, it is possible for the actuating member 6 to be produced from an elastomeric plastic and a hard plastic by injection molding using two-component technology.

Figure 5:
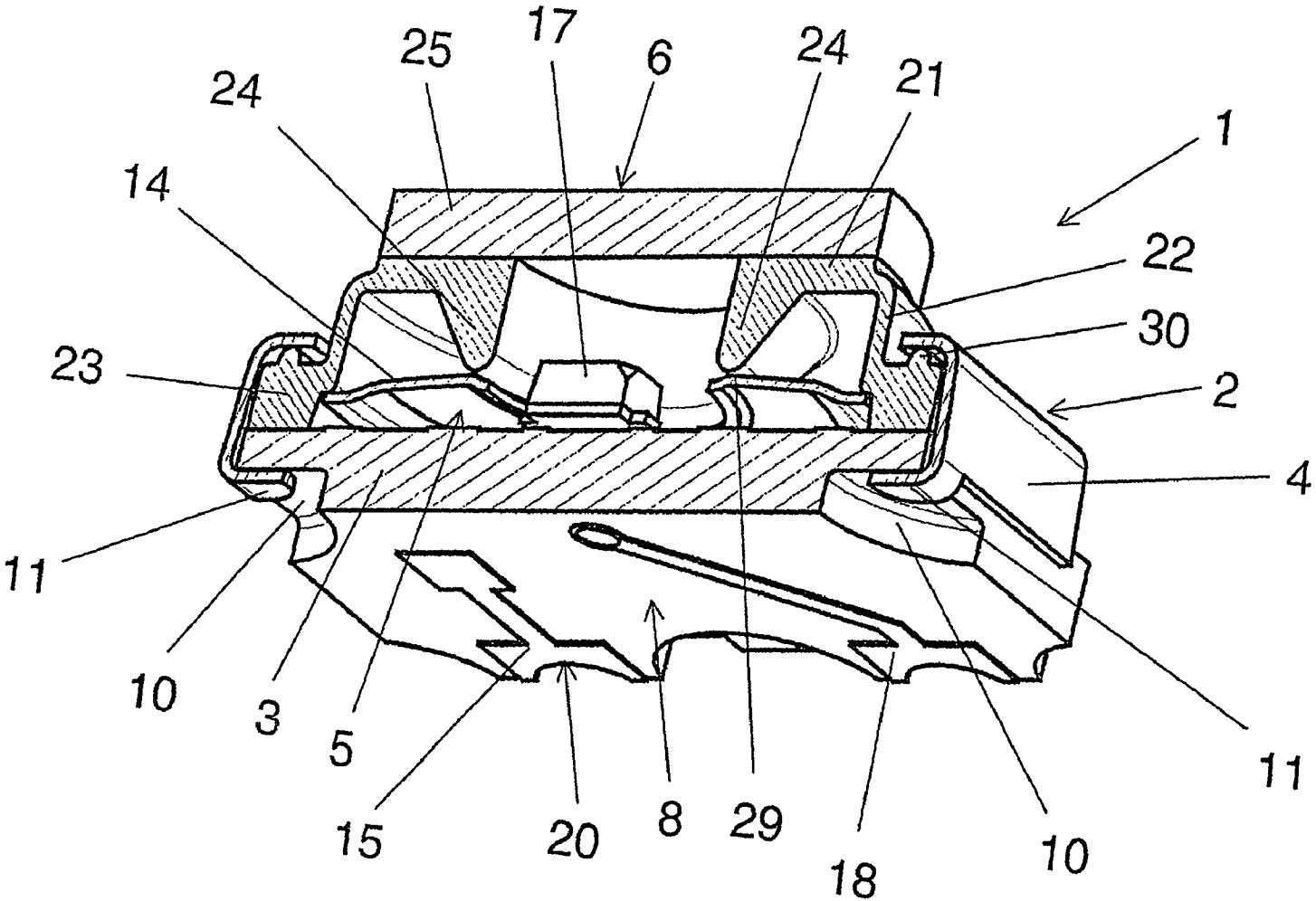
FIG. 5 is another perspective view of the longitudinal sectional view of FIG. 3.

The cover 4, which is made from metal, is in the form of a frame having an opening 26, as is shown in more detail in FIG. 2. As a result, the frame 4 firstly covers, in the manner of a profile, the edge surface 23 of the actuating member 6 and holds it firmly on the base 3. Secondly, the frame 4 at the opening 26 allows the bellows 22 of the actuating member 6 to pass through. Owing to the flanging by means of the tab-like attachments 11, the frame 4 thus exerts a certain amount of pressure on parts located in the housing 2 in order to fix these parts securely. In addition, this also provides for sealing in the interior of the housing 2, which can be further improved by a sealing lip 30 (shown in FIGS. 4 or 5) at the edge surface 23.

As has already been mentioned, the electrical switch 1 is designed such that it is capable of illuminating, for which purpose a luminous element 17 is located on the printed circuit board 3. Furthermore, the snap-in disk forming the switching contact 14 is provided with a hole 27, as shown in FIG. 2, and the luminous element 17 is arranged in the region of the hole 27 on the upper side 7 of the base 3 such that the light emitted by the luminous element 17 can pass at least partially through the hole 27 in the snap-in disk 14. Furthermore, the actuating member 6 is made at least partially from a transparent material in order that the emitted light is visible to the user.

As can be seen in FIG. 3, the snap-in disk 14 is in electrical contact with one fixed contact 12 by means of a resting surface 28 opposite the hole 27. The other fixed contact 13, as can primarily be seen in FIG. 2, is annular and is arranged so as to correspond to the edge 29 around the hole 27 in the snap-in disk 14. The luminous element 17 is arranged approximately in the center of the annular fixed contact 13. The edge 29 around the hole 27 in the snap-in disk 14 is designed to be raised with respect to the resting surface 28, as shown in FIG. 3. The attachment 24 on the pushbutton 21 is likewise annular. The attachment 24 interacts with the raised edge 29 around the hole 27 in the snap-in disk 14 so as to actuate it such that the raised edge 29 comes to bear, in snap-action fashion, against the annular fixed contact 13 when the snap-in disk 14 is actuated by the actuating member 6. In this connected state of the switch 1, the two fixed contacts 12, 13 are consequently bridged by the snap-in disk 14. In the disconnected state of the switch 1, on the other hand, the raised edge 29 is removed from the fixed contact 13, and thus the electrical connection between the two fixed contacts 12, 13 is interrupted.

The invention is not restricted to the exemplary embodiment described and illustrated. Rather, it also comprises all developments made by those skilled in the art within the context of the invention as defined by the patent claims. It can thus be used not only in an electrical switch as described, but can also be used in other electrical components, such as capacitors, resistors, coils or the like, which have a housing comprising a base and a cover. In order to fix the cover to the base, the cover at least partially covers the base on the upper side and on the side face, and the base has cutouts in the underside remote from the cover, attachments on the cover engaging in said cutouts in the manner of a flange such that the attachments are completely accommodated in the base and do not protrude beyond the underside of the base.

List of Reference Symbols

1: Electrical switch
2: Housing
3: Base/printed circuit board
4: Cover/frame
5: Contact system
6: Actuating member
7: Upper side (of base)
8: Underside (of base)
9: Side face
10: Cutout (in base)
11: Attachment (on cover)
12, 13: Fixed contact
14: Switching contact/snap-in disk
15, 16: Electrical terminal (for fixed contact)
17: Luminous element
18: Electrical terminal (for luminous element)
19: Conductor track
20: Throughplating
21: Pushbutton (of actuating member)
22: Bellows (of actuating member)
23: Edge surface (of actuating member)
24: Attachment (of actuating member)
25: Actuating surface (on pushbutton)
26: Opening (in cover)
27: Hole (in snap-in disk)
28: Resting surface (of snap-in disk)
29: Edge (of snap-in disk)
30: Sealing lip (on edge surface)

The invention claimed is:

1. An electrical switch comprising:

a housing comprising a base and a cover fixed on the base and at least partially covering the base on an upper side of the base and on a side face of the base; and a contact system, located in the housing, comprising fixed contacts and a switching contact, and having an actuating member that acts in a switching manner to actuate the switching contact of the contact system;

wherein the base comprises a laminar printed circuit board having electrical terminals, which are electrically connected to the fixed contacts, provided on a flat underside of the base, and at least one cutout formed in the underside of the base and positioned remote from the cover; and wherein the cover comprises at least one attachment that engages the at least one cutout in a flange manner such that the at least one attachment is accommodated in the base and is at the most flush with the underside of the base.

2. The electrical switch of claim 1, wherein the fixed contacts comprise conductor track surfaces formed on the upper side of the base, and wherein an electrical connection is provided between the electrical terminals on the underside of the base and the fixed contacts on the upper side of the base via one of a conductor track and a throughplating.

3. The electrical switch of claim 1, wherein the actuating member comprises a pushbutton protruding out of the housing, and wherein the actuating member has an edge surface positioned on the upper side of the base.

4. The electrical switch of claim 3, wherein the actuating member is at least partially made from an elastomeric plastic, and wherein the pushbutton is at least partially made from a hard plastic.

5. The electrical switch of claim 4, wherein the edge surface of the actuating member and the bellows are made from an elastomeric plastic.

6. The electrical switch of claim 4, wherein an actuating surface of the pushbutton is made from a hard plastic.

7. The electrical switch of claim 4, wherein the actuating member comprises an elastomeric plastic and a hard plastic produced using two-component technology.

8. The electrical switch of claim 3, wherein the pushbutton is connected to the edge surface of the actuating member via a bellows which elastically buckles inwardly.

9. The electrical switch of claim 3, wherein the pushbutton acts on the switching contact via an attachment.

10. The electrical switch of claim 1, wherein the cover comprises metal.

11. The electrical switch of claim 1, wherein the at least one attachment on the cover comprises a flanged tab extending from the side face of the base to the underside of the base.

12. The electrical switch of claim 11, wherein the cover and the base each have an approximately rectangular shape with four sides, and wherein four of the attachments are provided on the cover to engage a respective one of four of the cutouts provided on the base.

13. The electrical switch of claim 12, wherein the attachments and the corresponding cutouts are approximately centrally positioned with respect to the four sides of the cover and the base.

14. The electrical switch of claim 1, wherein the fixed contacts are located on the upper side of the base in the housing, and wherein the switching contact comprises a metal snap-in disk bridging the fixed contacts.

15. The electrical switch of claim 1, wherein electrical terminals for a luminous element located in the housing are arranged on the underside of the base.

16. The electrical switch of claim 15, wherein the luminous member comprises a light-emitting diode.

17. The electrical switch of claim 15, wherein the electrical terminals connecting the fixed contacts and the electrical terminal for the luminous element comprise soldering surfaces such that the switch can be processed using SMD (surface mounted device) technology.

18. The electrical switch of claim 1, wherein the cover comprises a frame having an opening such that the frame covers an edge surface of the actuating member in a profile manner and holds the actuating member firmly on the base and such that a bellows of the actuating member passes therethrough.

19. The electrical switch of claim 1, wherein the electrical switch has a short-stroke key form.

20. An electrical switch comprising:

a housing comprising a base and a cover fixed on the base and at least partially covering the base on an upper side of the base and on a side face of the base; and a contact system, located in the housing, comprising fixed contacts and a switching contact, and having an actuating member that acts in a switching manner to actuate the switching contact of the contact system;

wherein the base comprises a printed circuit board and electrical terminals, which are electrically connected to the fixed contacts, arranged on an underside of the base, and at least one cutout formed in the underside of the base and positioned remote from the cover;

wherein the cover comprises at least one attachment that engages the at least one cutout in a flange manner such that the at least one attachment is accommodated in the base and is at the most flush with the underside of the base; and wherein the switching contact comprises a snap-in disk provided with a hole, wherein a luminous element is arranged proximate the hole in the snap-in disk on the upper side of the base such that light emitted by the luminous element at least partially passes through the hole in the snap-in disk.

21. The electrical switch of claim 20, wherein the snap-in disk is in electrical contact with one of the fixed contacts via a resting surface opposing the hole of the snap-in disk, and wherein another of the fixed contacts is annular and is arranged to correspond to an edge around the hole.

22. The electrical switch of claim 21, wherein an annular attachment is provided on a pushbutton of the actuating member, and wherein the annular attachment interacts with the raised edge around the hole in the snap-in disk to actuate the snap-in disk.

23. The electrical switch of claim 21, wherein the luminous element is arranged approximately in a center of the annular fixed contact.

24. The electrical switch of claim 21, wherein the edge around the hole in the snap-in disk is raised with respect to the resting surface such that the raised edge bears against the annular fixed contact in a snap-action manner when the snap-in disk is actuated by the actuating member.

25. The electrical switch of claim 20, wherein the actuating member at least partially comprises a transparent material.

26. An electrical switch comprising a housing comprising a base and a cover fixed on the base and a contact system located in the housing and having an actuating member that acts in a switching manner on the contact system, wherein the switching contact comprises a snap-in disk provided with a hole, wherein a luminous element is arranged proximate the hole in the snap-in disk on an upper side of the base such that light emitted by the luminous element at least partially passes through the hole in the snap-in disk.

27. The electrical switch of claim 26, wherein the actuating member at least partially comprises a transparent material.

* * * * *